United States Patent [19]

Dean et al.

[11] Patent Number: 4,582,541

[45] Date of Patent: Apr. 15, 1986

[54] PROCESS FOR PRODUCING STRIP SUITABLE FOR CAN LID MANUFACTURE

[75] Inventors: Robert J. Dean, Hombrechtikon; Peter Furrer, Pfungen; Kurt Neufeld, Zurich, all of Switzerland

[73] Assignee: Swiss Aluminium Ltd., Chippis, Switzerland

[21] Appl. No.: 553,236

[22] Filed: Nov. 18, 1983

[30] Foreign Application Priority Data

Dec. 16, 1982 [CH] Switzerland ..... 7328/82

[51] Int. Cl.[4] ..... C21D 8/02

[52] U.S. Cl. ..... 148/2; 148/11.5 A

[58] Field of Search ..... 148/2, 11.5 A, 439, 148/440; 420/534, 535; 164/476, 486; 72/41, 42

[56] References Cited

U.S. PATENT DOCUMENTS 3,502,448 3/1970 Anderson et al. ..... 148/11.5 A
3,960,607 6/1976 Manzonelli et al. ..... 148/439
3,966,619 6/1976 Smith et al. ..... 72/42
4,282,044 8/1981 Robertson et al. ..... 148/11.5 A
4,411,707 10/1983 Brennecke et al. ..... 148/2

OTHER PUBLICATIONS

Metals Handbook, Ninth Edition, vol. 4, "Heat Treating", American Society for Metals, 1981, pp. 707–709.

*Primary Examiner*—L. Dewayne Rutledge
*Assistant Examiner*—Robert L. McDowell
*Attorney, Agent, or Firm*—Bachman & LaPointe

[57] ABSTRACT

An aluminum alloy containing 0.15–0.50% Si, 0.3–0.8%, Fe, 0.05–0.25% Cu, 0.5–1.0% Mn, 2.5–3.5% Mg and up to 0.20% Ti is cast as a 5–10 mm thick strip using a roll-type strip casting machine, and cold rolled to a final thickness of 0.20–0.40 mm. The strip is suitable for manufacture into can lids having high strength and formability requirements.

5 Claims, No Drawings

PROCESS FOR PRODUCING STRIP SUITABLE FOR CAN LID MANUFACTURE

BACKGROUND OF THE INVENTION

The invention relates to a process for producing an aluminum alloy strip by means of a strip casting machine, such that the said strip is suitable for can lid manufacture.

Can lids, in particular for beverage can bodies made of aluminum or steel, are mostly made of aluminum alloys. The most widely used process for manufacturing such beverage can lids is as follows.

The aluminum alloy AA 5182 containing the following main alloying constituents 4.4% magnesium, 0.3% manganese, 0.3% iron and 0.15 silicon is continuously chill cast as 30–40 cm thick ingots. These ingots are scalped, homogenized and hotrolled in several passes to a thickness of 2–3 mm. This strip is then usually annealed and cold rolled to an end thickness of 0.25–0.35 mm. Often the final rolled strip is subjected to a slight softening treatment at 170°–200° C. in order to prevent the strip from distorting during the paint baking. Before shaping into can lids the strip is coated with paint on both sides and then baked at 190°–220° C., typically 8 minutes at 204° C.

As the recycling of aluminum is gaining in importance, in the USA more than half of all the used aluminum cans are returned for remelting, efforts have been made for some time now to develop an alloy which is equally suited for can bodies and can lids or at least can be made so after only small corrections to the common scrap from both lid and can body. In this connection the amount of primary aluminum required should in particular be as little as possible. This is not the case for the conventional alloys viz. AA 5182 for can lids and AA 3004 for can bodies as the alloy AA 3004 contains 1% magnesium, 1% manganese, 0.45% iron, 0.25% silicon and 0.15% copper, so that the resultant scrap contains approximately 1.6% magnesium, 0.7% manganese, 0.4–0.5% iron, 0.25% silicon, 0.1% copper and over 0.05% titanium.

Known from the U.S. Pat. No. 3,787,248 is a process which should make it possible to produce aluminum cans and lids from the same alloy. This alloy contains essentially 0.4–2.0% magnesium and 0.5–2.0% manganese. The process for manufacturing can lid material comprises continuous DC casting, homogenizing, hot rolling and subsequent cold rolling and annealing operations.

Known from the U.S. Pat. No. 4,235,646 is an economically attractive process for producing from one single aluminum alloy strip suitable for manufacturing deep drawn and ironed can bodies and can lids. This alloy contains essentially 1.3–2.5% magnesium and 0.4–1.0% manganese and can be made from the conventional can scrap without substantial addition of primary aluminum. The process for manufacturing the can lid stock comprises strip casting, hot rolling and cold rolling, the solidification rates employed being at the average level for example in the Hazelett or Alusuisse Caster II strip casters where the solidification takes place between casting belts or caterpillar track molds.

To save material, efforts are being made to reduce the thickness of the can lid. To meet the same requirements in terms of rigidity of the lid therefore both changes in design and a considerable increase in the strength of the material are necessary. With the above mentioned processes, however, these possibilities are limited.

In addition, the search for less expensive processes continues further.

SUMMARY OF THE INVENTION

The object of the present invention is therefore to develop a process for manufacturing can lids which features the following:

extensive use of recycled metal achieving high strength values without loss of formability economic production.

This object is achieved by way of the invention making use of conventional roll-type strip casting such as, for example, is represented by the Hunter-Engineering or Alusuisse Caster I strip casters where the solidification takes place between two rolls cooled from within.

Selected for can lid stock is an aluminum alloy containing essentially 0.15–0.50% silicon, 0.3–0.80% iron, 0.05–0.25% copper, 0.5–1.00% manganese, 2.5–3.5% magnesium and up to 0.20% titanium.

The solidified cast strip emerges from the casting rolls at a speed of 0.3–0.8 m/min with a thickness of 5–10 mm, and is cold rolled to a final thickness of 0.20–0.40 mm.

DETAILED DESCRIPTION

The high rate of solidification achieved during roll-type strip casting makes possible high supersaturation of dissolved alloying elements and contributes thus to the strength of the lid stock.

To improve the formability it is also propsed in accordance with the invention to subject the sheet to a partial softening anneal prior to painting. This can be in form of a coil anneal at 180°–215° C. for 0.5 to 8 hours or as continuous annealing at 200°–235° C. for 10 seconds to 10 minutes.

It is preferred in accordance with the present invention for the cold rolling to end thickness to take place using a water based rolling emulsion. With the large reductions which this makes possible on each pass the temperature of the coiled sheet can reach ca. 160°–220° C. Due to the resultant softening which this produces an additional softening anneal-step is eliminated.

To improve the formability of the lid stock further, an intermediate anneal can be introduced in the course of rolling to end thickness. This intermediate anneal should take place when the material has 4–10 times the final thickness, and either in the form of coil annealing at 300°–410° C. (metal temperature) for a duration of half an hour to 8 hours, or in the form of continuous annealing at a metal temperature of 300°–440° C. for 2 seconds to 2 minutes.

The following example represents one of the possible versions of the process according to the invention:

Composition:

| | Si | Fe | Cu | Mn | Mg | Ti | Al |
|---|---|---|---|---|---|---|---|
| Wt. % | .21 | .46 | .07 | .72 | 2.94 | .02 | 95.50 |

Thickness of cast strip: 6.5 mm

Casting rate: 60 cm/min

Cold rolling to 1.9 mm

Intermediate anneal: 380° C./2 h MT

Cold rolling (without emulsion) to 0.315 mm, or 0.330 mm

Annealing: 205° C./8 min

Painting, baking: 204° C./8 min

Mechanical properties of painted lid stock (in rolling direction):

| | | |
|---|---|---|
| Proof stress | Rp 0.2: | 321 MPa |
| Tensile strength | Rm: | 376 MPa |
| Elongation at fracture | A2": | 7.7% |

The strips of both thickness were converted to beverage can-lids of the integral rivet type. The resultant buckle strength values were:

0.330 mm: 0.70 MPa=102 psi 0.315 mm: 0.65 MPa=94 psi

What is claimed is :

1. Process for producing an aluminum alloy strip suitable for can lid manufacture which comprises providing an aluminum alloy melt containing 0.15–0.50% silicon, 0.3–0.8% iron, 0.05–0.25% copper, 0.5–1.0% manganese, 2.5–3.5% magnesium and up to 0.20% titanium, providing a strip casting machine having casting rolls with a 5–10 mm wide gap therebetween, introducing said melt into said 5–10 mm wide gap to form a strip 5–10 mm in thickness, and cold rolling the resultant strip to a final thickness of 0.40–0.20 mm to provide strip suitable for can lid manufacture with high strength values without loss of formability, wherein the cold rolling to final thickness takes place using a water-based rolling emulsion as a result of which large reductions are possible on each pass and self-induced softening takes place at a coil temperature of 160°–220° C. thereby eliminating an additional softening-anneal step.

2. Process according to claim 1 wherein the solidified cast strip emerges from the casting rolls at a speed of 0.3 to 0.8 meters per minute.

3. Process according to claim 1 including the step of subjecting the strip to an intermediate anneal during rolling to final thickness at a thickness 4 to 10 times the final thickness at a temperature from 300°–440° C.

4. Process according to claim 3 wherein the intermediate anneal is in the form of coil annealing at a metal temperature of 300°–410° C. for 0.5–8 hours.

5. Process according to claim 3 wherein the intermediate anneal is in the form of continuous strip annealing at a metal temperature of 300°–440° C. for 2 seconds to 2 minutes.

* * * * *